US005137465A

United States Patent [19]

Chwang

[11] Patent Number: 5,137,465

[45] Date of Patent: Aug. 11, 1992

[54] LIGHTBULB AND SOCKET CONNECTING MECHANISM

[75] Inventor: Wen T. Chwang, Hsinohu, Taiwan

[73] Assignee: Cubiform Design & Development Co., Inc., China

[21] Appl. No.: 723,826

[22] Filed: Jul. 1, 1991

[51] Int. Cl.[5] ..... H01R 13/627

[52] U.S. Cl. ..... 439/356; 439/699; 313/318

[58] Field of Search ..... 313/51, 318; 439/356, 439/611-619, 699, 918

[56] References Cited

U.S. PATENT DOCUMENTS

| | | | |
|---|---|---|---|
| 3,104,924 | 9/1963 | Capel | 439/619 |
| 3,371,306 | 2/1968 | Moranduzzo | 439/699 X |
| 4,298,923 | 11/1981 | Lin | 439/699 X |
| 4,679,126 | 7/1987 | Van Sickler . | |
| 4,803,396 | 2/1989 | Kelner | 313/318 |
| 5,001,615 | 3/1991 | Stefanelli . | |

FOREIGN PATENT DOCUMENTS

| | | |
|---|---|---|
| 78-210590 | 1/1978 | Taiwan . |
| 79-205791 | 3/1978 | Taiwan . |

*Primary Examiner*—Steven C. Bishop
*Assistant Examiner*—Khiem Nguyen
*Attorney, Agent, or Firm*—Andrus, Sceales, Starke & Sawall

[57] ABSTRACT

An improvement on the connecting mechanism for the lightbulb and bulb socket assembly, includes a socket having a shape of a cup and which can receive connecting wires in its lower part; a lightbulb having a shape a cup and can be received by the socket, characterized in that in the edge of top surface of the lightbulb extends horizontally and outwardly a grasping plate and the grasping plate forms a groove jointly with the top surface of the bulb socket.

8 Claims, 2 Drawing Sheets

LIGHTBULB AND SOCKET CONNECTING MECHANISM

FIELD OF THE INVENTION

The present invention relates an improvement of a connecting mechanism, particular to an improvement on the mechanism for a lightbulb and bulb socket assembly.

DESCRIPTION OF THE PRIOR ARTS

The light strings have been widely used to decorate the Christmas tree or the like because it brings a warming feeling to the family and the passersby. During this season, it brings much joy to children as well as adults.

Because of the snow weather and blowing wind, some of lightbulbs on the Christmas tree will drop down from the bulb sockets after dangling in the wind. Hence the warm atmosphere is likely to be harmed.

By the way, the replacement and repair of said lightbulbs is difficult in such a cold weather. Hence, some improvements to decrease this problem come to market.

In Taiwan utility patent, 78210590, the inventor provided a novel connecting mechanism for a lightbulb and bulb socket. The inventor uses a clipping plate having a hole thereon provided on the litebud locks to a button equipped on the outer wall of the bulb socket. No doubt the locking engagement of clipping plate and button suitably prevent the drop down of the lightbulb from the bulb socket.

But it has the following shortcoming.

While the lightbulb is engaged into the bulb socket, there is not gap between the lightbulb and bulb socket. Because the cold weather requires wearing a heavy glove, the customer can not separate the two easily for replacement of bulb even if there is a clipping plate and button attached thereon. As we want to use some tool such as a screw driver to separate them, we can not find a fulcrum for the tool. This problem becomes serious when the bulb portion on the lightbulb is broken.

Besides, the manufacture of such clipping plate is quite expensive because the attachment of said clipping plate to the socket is difficult to control, hence causing the clipping plate to detach from said bulb socket easily.

In Taiwan utility application 79205791 now abandoned, the inventor provided another kind of locking mechanism for lightbulb and bulb socket. Again it has the difficulty like the above-mentioned of the inability to easily separate the two elements. Its structure also can not find a fulcrum for applying a tool.

It is the object of the present invention to solve all the problems of the prior art and provide a novel improvement on the connecting mechanism for the lightbulb and bulb assembly.

SUMMARY OF THE PRESENT INVENTION

In accordance with this invention, there is provided an improvement on the connecting mechanism for the lightbulb and bulb socket assembly, including a bulb socket having a shape of cup and receiving connecting wires in its lower part; a lightbulb having a shape of cup and can be received by said bulb socket, characterized in that in the edge of the top surface of said lightbulb extends horizontally and outwardly a grasping plate, said grasping plate defines a groove jointly with said top surface of said bulb socket.

The structural and operational characteristics of the present invention and its advantages as compared to the known state of the prior art will be better understood from the following description, relating to the attached drawings which shown an example of an improvement on the mechanism for the lightbulb and bulb socket assembly of the invention. In these drawings.

Figure 6:
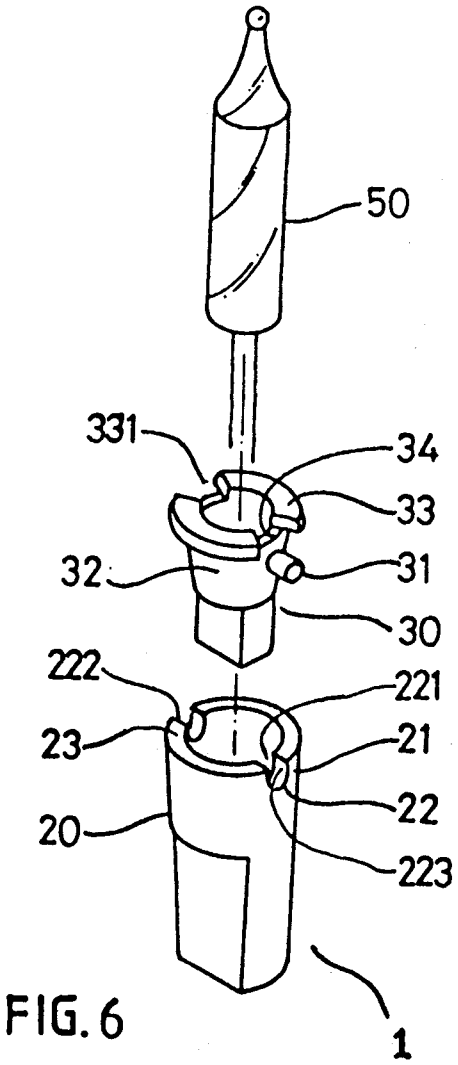
FIG. 6 is a third embodiment of this invention showing each individual part in exploded view.
Figure 1:
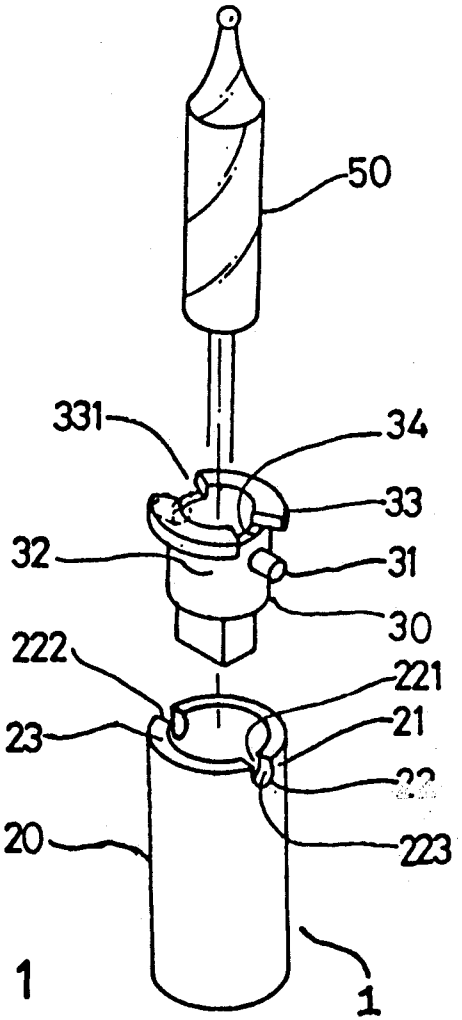
FIG. 1 is the perspective view of this invention showing each individual part in exploded view.
Figure 2:
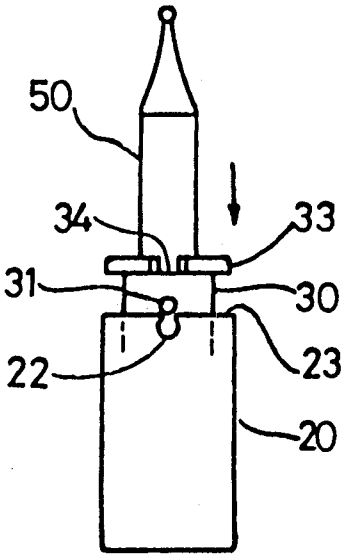
FIG. 2 is the front view of this invention showing the combination of the lightbulb and bulb socket.
Figure 3:
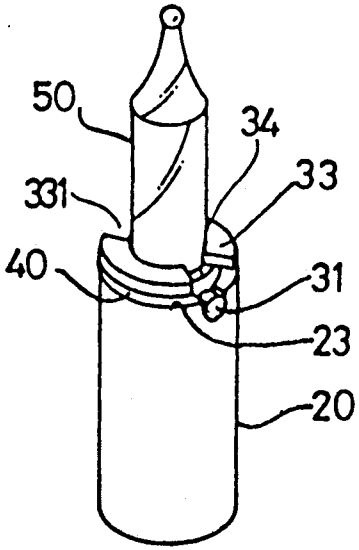
FIG. 3 is a perspective view of this invention showing a lightbulb and bulb socket after the engagement.
Figure 5:
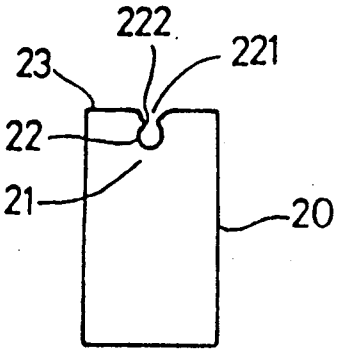
FIG. 5 is a second embodiment of this invention showing a alternative the bulb socket.

Please refer to FIG. 1, the lightbulb and bulb socket assembly 1 comprises a bulb socket 20 having a shape which is known and has a slot 22 on its outer wall 21. Said slot 22 has an opening 221 in the top surface 23 of said bulb socket 20. Said slot 22 further comprises a projection 222 in its inner wall 223 (see FIG. 2). A lightbulb 30 has the same shape as the prior art and has a projection 31 in its outer wall 32. The outer diameter of said projection 31 is same with the width of said slot 22 of said bulb socket 20. As said lightbulb 30 engages with said bulb socket 20, said projection 31 can slip over said projection 222 and be retained within said slot 22. For the easy engagement of said projection 31 and said slot 22, said opening 221 has a V-type slope in order to receive said projection 31 more easily. See FIG. 5 showing a second embodiment of this invention having a alternative socket.

Figure 4:
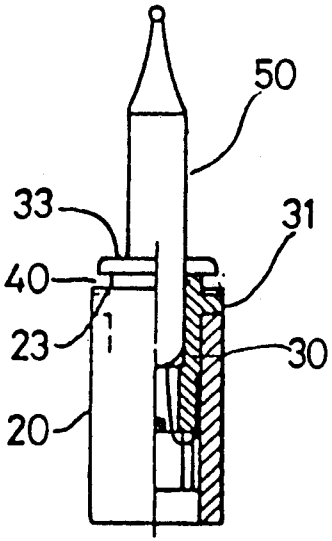
FIG. 4 is a section view showing the engagement of said projection of the lightbulb and said slot of the bulb socket.

Said lightbulb 30 further comprises a grasping plate 33 in its top surface 34. Said grasping plate 33 extends horizontally and outwardly to the diameter of said bulb socket 20. Hence said grasping plate 33 and said top surface 23 jointly define a groove 40, see FIG. 4, which further provides a stand for the fingers or tool such as a screwdriver. Said grasping plate 33 is in the shape of crescent and leaves an opening 331 above said projection 31. This opening 331 will make the manufacture of this lightbulb 30 much easier and without loss.

As a fulcrum is provided by this invention, the replacement of lightbulb becomes much easier despite cold weather. The customer can use his fingers and find a suitable fulcrum for applying force, even if he wears a glove. The customer can use a tool, such as a screwdriver, to insert into the groove 40 defined by said grasping plate 33 and said top surface 23 of said bulb socket 20 and dig said lightbulb 30 out of said bulb socket 20 by a simple rotation.

Since said grasping plate 33 has a larger diameter than said bulb 50, during the replacement, the fingers will not reside on said bulb 50. Since most of the force is located on said grasping plate 33, the bulb 50 will not be broken by excess force. Besides, even if said bulb 50 is broken, grasping plate 33 will still make the replacement of said lightbulb 30 safely and easily.

These advantage of this present invention will be apparent to those skilled in the art. Thus the embodiment described in this specification is only by way of example and should not be construed as restrictive. The scope of this invention is indicated by the appended claims, and all the modifications thereby embraced are included in this present invention.

I claim:

1. An improved lightbulb-socket connecting mechanism comprising:

a bulb socket having a tubular wall and which can receive connecting wires in one end thereof, said bulb socket having at least one slot extending through said wall and having an opening on the other end of said bulb socket; and a lightbulb assembly having a connection portion and a bulb extending from said connection portion, said connection portion having a shape of a cup which can be received by said bulb socket, said assembly having a grasping plate extending outwardly from an edge of said connection portion adjacent said bulb, said grasping plate being formed as at least one arcuate segment, said connection portion having at least one columnar projection projecting outwardly from a discrete location on an outer wall of said connection portion, said projection being spaced along said outer wall from said grasping plate and being engageable in said slot for retaining said lightbulb assembly in said bulb socket, said grasping plate being spaced from said other end of said bulb socket when said assembly is received in said bulb socket to define a groove with said other end of said bulb socket, said grasping plate having an opening above said projection by which the engagement of said projection in said slot may be viewed.

2. The improved connecting mechanism of claim 1 wherein said slot is a V-type form.

3. The improved connecting mechanism of claim 1 wherein said slot further includes a projection in the wall of said slot projecting into the slot and reducing the opening of said slot on said other end of said bulb socket.

4. The improved connecting mechanism of claim 2 wherein said slot further includes a projection in the wall of said slot projecting into the slot and reducing the opening of said slot on said other end of said bulb socket.

5. The improved connecting mechanism of claim 1 wherein the transverse dimension of said projection of said lightbulb assembly is the same as the width of said slot, so that said projection can be received by said slot and retained therein.

6. The improved connecting mechanism of claim 1 wherein the length of said projection normal to said outer wall of said connection portion is such that said projection projects beyond the wall of said bulb socket.

7. The improved connecting mechanism of claim 5 wherein the length of said projection normal to said outer wall of said connection portion is such that said projection projects beyond the wall of said bulb socket.

8. The improved connecting mechanism of claim 1 wherein the opposing surfaces of said grasping plate and said bulb socket have the same general dimensions.

* * * * *